US005149195A

United States Patent [19]

Löfgren

[11] Patent Number: 5,149,195

[45] Date of Patent: Sep. 22, 1992

[54] AGITATOR

[76] Inventor: Stefan Löfgren, Klöse 118, S-914 00 Nordmaling, Sweden

[21] Appl. No.: 476,389

[22] PCT Filed: Dec. 15, 1988

[86] PCT No.: PCT/SE88/00684

§ 371 Date: May 29, 1990

§ 102(e) Date: May 29, 1990

[87] PCT Pub. No.: WO89/06160

PCT Pub. Date: Jul. 13, 1989

[30] Foreign Application Priority Data

Dec. 30, 1987 [SE] Sweden ..... 8705205

[51] Int. Cl.[5] ..... B01F 7/22

[52] U.S. Cl. ..... 366/343; 366/265

[58] Field of Search ..... 366/342, 343, 263, 266, 366/314, 265; 68/53

[56] References Cited

U.S. PATENT DOCUMENTS

| | | | |
|---|---|---|---|
| 937,974 | 10/1902 | Trent | 366/263 |
| 1,080,177 | 12/1913 | Still | 366/265 |
| 2,530,814 | 11/1950 | Becze | 366/266 |
| 3,147,957 | 9/1964 | Martin | 366/263 |
| 3,339,897 | 9/1967 | Davis, Jr. | 366/266 |
| 3,479,017 | 11/1969 | Thikötter | 366/342 |
| 4,664,530 | 5/1987 | Kurome et al. | 366/314 |
| 4,893,941 | 6/1990 | Wayte | 366/343 |

FOREIGN PATENT DOCUMENTS

| | | | |
|---|---|---|---|
| 0265991 | 10/1968 | Austria . | |
| 0828100 | 1/1952 | Fed. Rep. of Germany | 366/263 |
| 2714308 | 10/1978 | Fed. Rep. of Germany | 366/263 |
| 1152636 | 4/1985 | U.S.S.R. | 366/263 |

*Primary Examiner*—Philip R. Coe
*Assistant Examiner*—Tony Soohoo
*Attorney, Agent, or Firm*—Kinzer, Plyer, Dorn, McEachran and Jambor

[57] ABSTRACT

An agitator comprises a vessel having an intake (101) through which a medium is introduced into the vessel, and rotating guide devices (12) for guiding and discharging the medium. The inner and outer defining surfaces of the vessel have a hyperbolic, conical shape and the cross-sectional area of the intake increases progressively towards the guide devices. The guide devices (12) extend horizontally towards the periphery of the vessel and are mounted on a horizontal rotatable bottom plate (11) which is driven for rotation from beneath.

7 Claims, 2 Drawing Sheets

FIG. 1
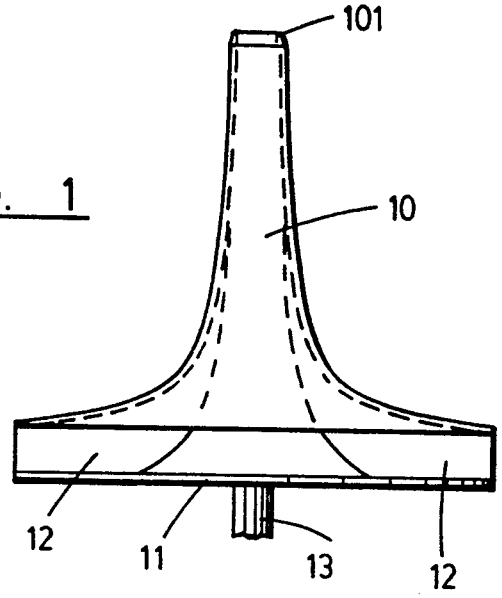
FIG. 2
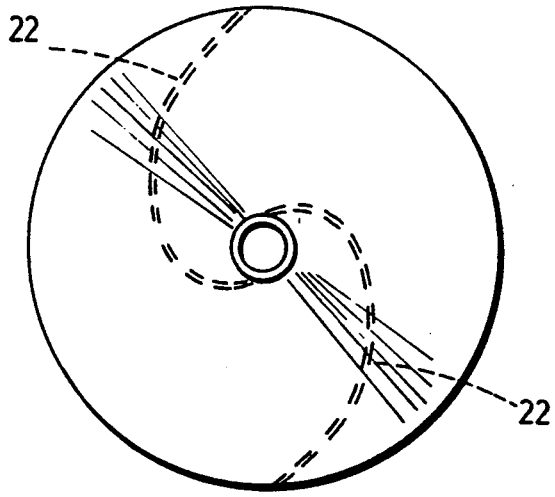
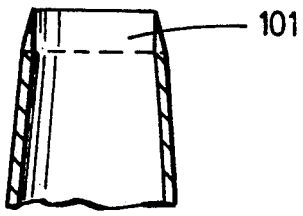
FIG. 3

AGITATOR

TECHNICAL FIELD

The present invention relates to an agitator or like vortex generator of the kind comprising a vessel which has provided in the upper part thereof an intake for introducing a moving medium into the vessel and in the bottom part thereof a plurality of rotatable guide devices from the vessel effective in guiding and discharging the downcoming medium from the vessel.

BACKGROUND PRIOR ART

Agitators intended for the preparation of mixtures, solutions, emulsions etc. are known to the art, for instance from Austrian Patent Specification 265 991. These known apparatus are used, for instance, to prepare beverages, purify water or for various kinds of biological processes. The apparatus may comprise an egg-shaped reaction vessel which accommodates the liquid to be processed. Arranged in the lower parts of the vessel is a single-blade or multi-blade device which is driven from beneath the vessel, while arranged in the upper part of the vessel is an inlet opening for the introduction of secondary solid, liquid or gaseous additive substances into the vessel.

One problem with such apparatus and other, similar apparatus is that they generate turbulent flows which move in mutually different directions and therewith counteract the generation of a desired natural vortex, a problem which can only barely be solved and then at the price of a higher energy input. No optimal solution has hitherto been proposed, however.

The object of the present invention is, inter alia, to eliminate the aforesaid drawbacks in a rational, energy-lean and therewith environmentally friendly manner, by isolating any possible turbulent liquid movement from a vortex which is engendered naturally in regions above the rotatable device, provided that no disturbances are conducted upwardly towards the centre of the vortex. This will also result in all of the liquid mass accompanying the rotational movement. By vortex is meant here all manner of ordered movement of fluid particles which will generate a central vacuum and therewith a downward suction force.

SUMMARY OF THE INVENTION

Accordingly, the invention relates to an agitator of the aforedescribed kind which is mainly characterized in that the inner defining surface of the vessel has a hyperbolic, conical and rotational-symmetrical shape, in that the intake has a cross-sectional area which increases progressively towards the guide devices, and in that the guide devices have the form of vanes or like guide devices which extend towards the periphery of the vessel and which are mounted on a horizontal, rotatable bottom plate which is driven from beneath.

Other characteristic features of an inventive agitator are set forth in the accompanying claims.

BRIEF DESCRIPTION OF THE DRAWINGS

The invention will now be described in more detail with reference to the accompanying schematic drawings, in which FIG. 1 is a side view of an inventive agitator, FIG. 2 is a highly schematic plan view illustrating the configuration of the guide vanes of an alternative agitator, FIG. 3 is a detail view of the upper part of the agitator.

DESCRIPTION OF PREFERRED EMBODIMENTS

Figure 4:
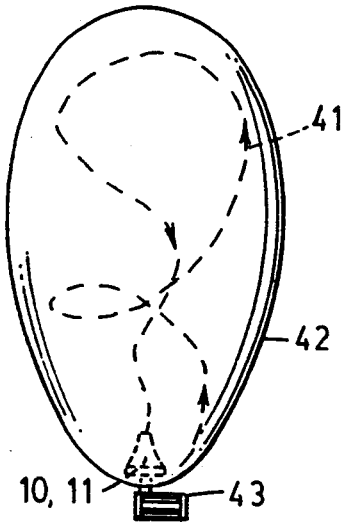
FIG. 4 illustrates an inventive agitator which is totally enclosed in an egg-shaped container.

The agitator illustrated in FIG. 1 includes a hyperbolic conical and rotational-symmetrical vessel 10, the inner and outer defining surfaces of which each have the shape illustrated. Located in the upper part of the vessel is an intake 101 through which a medium, such as water, blood, gas, etc., is introduced into the vessel and the cross-sectional area of which increases progressively in a downward direction.

Arranged beneath the vessel 10 is a horizontal, rotatably driven plate 11, said plate being driven from beneath. The plate has disposed thereon guide vanes or like devices 12 which are effective in guiding the moving medium arriving from above and discharging said medium from the vessel. The plate 11, the guide vanes 12 carried thereby, and the vessel 10 are rotated together by virtue of a motor which drives a shaft 13 mounted in the centre of the plate 11, from beneath said plate. Located between the vanes are openings through which the medium is forcibly ejected from the vessel.

The guide vanes of the FIG. 1 embodiment are planar and two in number. The upper parts of respective guide element are contiguous with the inner surface of the vessel 10 and the extreme parts of the vanes are attached to said surface.

FIG. illustrates highly schematically the guide vanes 22 of an alternative agitator constructed in accordance with the invention. These guide vanes are of arcuate configuration, and the agitator includes a vessel of the same configuration as the vessel of the FIG. 1 embodiment.

Thus, when the agitator is in operation, moving medium will be sucked in through the intake 101 and drawn downwards at an accelerated speed, towards the centrifugally active guide vanes 12, therewith to be thrown out horizontally through the openings between the guide vanes, and will then continue upwards, outwardly of the vessel, towards the intake 101 in a circular movement path.

The dimensions of the vessel and guide vanes, the number of vanes provided, and the speed of rotation are all highly dependent on the type of medium involved and also on the purpose for agitating, or stirring, the medium and for creating a natural vortex.

The construction of the inventive agitator is highly contingent on the requirement of the occurrence of a "natural vortex". The properties of a natural vortex are such as to ensure that such materials as, for instance, fertilizer, digestive sludge, fibrous material etc. can be mixed effectively;

that there is created a central suction force which can be utilized to dissolve gases in liquid, e.g. for the purpose of oxygenating water, purifying industrial effluence with the aid of vortex scrubbers, and compacting in the centre of the vortex particles of higher specific gravity than water, which property can be utilized in water purifying separation processes, the collection of oil in oil slicks, the purification of gases etc;

that an extremely uniform and finely divided dispersion of substances in a medium is achieved, which property can be utilized in the production of emulsions, suspensions and colloidal solutions and also in the production of finely divided oil/water vapour mixtures in the burners of oil fired plants;

that there occurs in the same direction as that of the collecting suction force a rotational movement which will also cause the outer layer of a medium to rotate, a phenomenon which can be utilized to improve the efficiency of hydro-electric power stations through the virtue of the fact that the kinetic energy of the water through said rotation will also be delivered to the turbines of the power stations; and that in the process of industrial synthesis, e.g. within the pharmacological field for the regeneration of biologically diseased water, etc., highly significant chemical/physical/biological synthesizing and reconstruction processes will take place in the centre of the vortex.

It will be understood herefrom that the inventive concept can be applied in many different ways and that the term "agitator" used here is a collective expression which is intended to define a device capable of being used effectively in a large number of different fields of use and applications. It will also be understood that the dimensions of the various components and elements used and the operational parameters of the agitator will depend greatly on the precise field in which the agitator is used. A number of dimensioning examples are given below.

EXAMPLE 1

Blood oxygenation.

Largest diameter 5 mm–20 mm; height max 20 mm; rotational speed 1000–5000 rpm.

EXAMPLE 2

Preparation of colloidal solutions.

Largest diameter 5 mm–100 mm; height max 100 mm; rotational speed 1000–20000 rpm.

EXAMPLE 3

Fish farming and cultivating equipment.

Largest diameter 5 mm–1000 mm; height max 1000 mm; rotational speed 500–3000 rpm.

EXAMPLE 4

Oxygenation of water in conjunction with:

a) greenhouse cultivation, largest diameter 50–200 mm, height max 200 mm; rotational speed 1000–20000 rpm.

b) cleansing of lakes, largest diameter 1–10 m, height max 10 m; rotational speed 10–1000 rpm.

The following effects are achieved by means of an agitator-vortex generator which is constructed in accordance with the invention;

Effective agitation of a medium; the whole of the medium will accompany the movement induced, to a greater or lesser extent;

substances present in a medium, e.g., in the preparation of colloidal solutions, suspensions, and emulsions, will be finely dispersed in an effective manner;

gas is sucked into liquid at only a small energy input;

wind power can be utilized in certain applications, by constructing the agitator for operation at relatively low rotational speeds;

the agitator can be mass produced at low costs.

According to one preferred embodiment of the invention, the outer side of the intake 101 ground down to form a sharp "edge", as illustrated in FIG. 3 which shows the uppermost part of the agitator intake.

As will be understood from the aforegoing, when the agitator-vortex generator is in use, the medium, e.g. a liquid, will be drawn by suction into the vessel and thrown outwardly from the bottom of the vessel and is again sucked in through the intake at the top of the vessel. In this way there is generated a natural vortex which has highly ordered movement in the medium, while utilizing the prevailing centripetal force. Thus, practically no disturbances will occur upwardly against the central position of the vortex, such disturbances otherwise jeopardizing the generation of the vortex. This is in contradistinction to conventional agitators which operate predominantly with centrifugal movement. Because of the predominant suction function of the agitator, all solid particles in the vessel are given the possibility of passing through the intake, i.e. a most effective agitation-vortex generation is achieved at relatively low energy consumption.

The inventive agitator can be used both in a closed container and in an open-surface body of water.

In accordance with one particularly advantageous embodiment of the invention, illustrated in FIG. 4, the agitator 10–11 is placed in a closed container 42. The illustrated container has the shape of an egg and the agitator is placed in the pointed end of the container. The object in this case may be to regenerate biologically diseased water and to carry out chemical, biochemical and biological syntheses. In this case the liquid is, for instance, oxygenated at sub-pressures.

Figure 5:
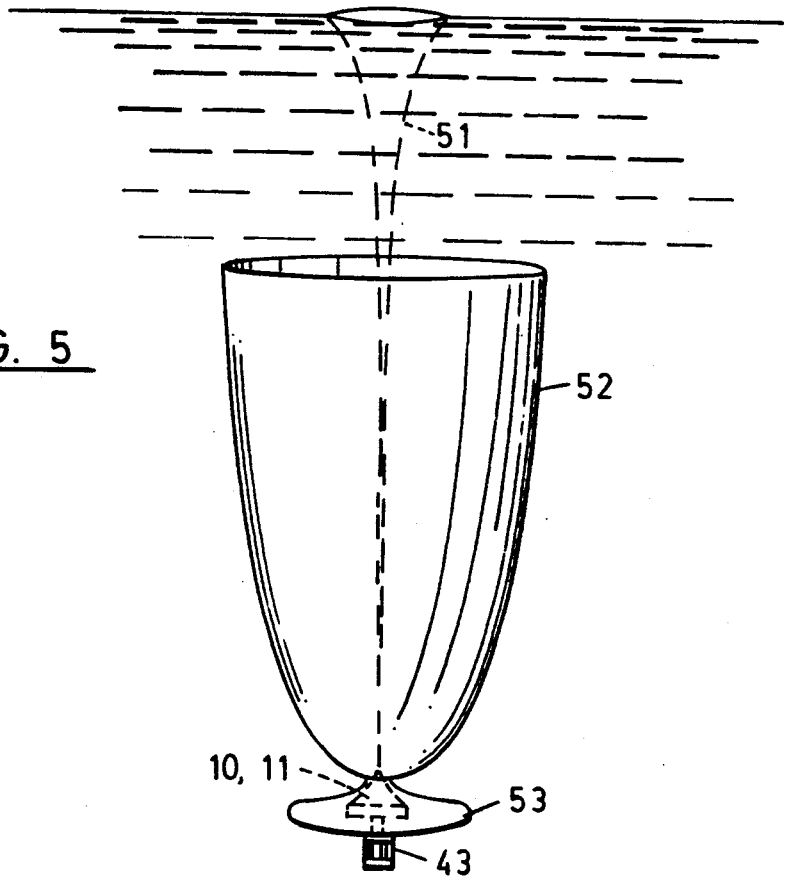
FIG. 5 illustrates an agitator arranged in a free-surface body of water and co-acting with a parabolic, outwardly open rotational body.

When the agitator is to be used in a body of water having a free surface, the agitator is suitably used in conjunction with a parabolic rotational body (FIG. 5). This body will have a hole provided in the bottom thereof, the diameter of said hole corresponding to the diameter of the upper part of the agitator (the intake) so that the intake which projects slightly into the rotational body will fit sealingly in the body. The rotational body may be suspended in the water with the aid of boyant bodies. In this instance, the agitator will only generate suction within the parabolic rotational body and force liquid up and around the outside of said body. As a result there is engendered a "rotating body of water" which will oxygenate water highly effectively. The rotational body significantly increases the depth of the vortex and the agitator will effectively oxygenate an oxygen-poor lake or regions at the sea bottom, because all oxygen-rich water is discharged and directed in a flow towards the bottom.

In FIG. 5, the broken line 51 illustrates schematically the creation of the external vortex, partially in the stationary, parabolic rotational body 52 where a suction force is generated. The bottom of the body merges with an opposing open-bottom hyperbolic body 53, which is also stationary and beneath which pressure is generated.

The effective oxygenation of water achieved when using the inventive agitator in the aforesaid manner is thought to be as a result of the relatively narrow, fine and sinusoidal vortex generated by means of the inventive agitator, which vortex has been found, in tests carried out, to have a fine, extremely elongated trumpet-shaped extension, as opposed to the highly compacted, rapidly rotating bodies of water obtained with conventional type agitators, which generate a short, linearly conical air column.

FIG. 4 illustrates schematically in broken lines 41 the generation of an internal vortex within the closed container. The reference 43 identifies a motor for driving the agitator 10–11.

I claim:

1. An agitator of the type which operates while fully submerged in a fluid, said agitator including a vessel (10), said vessel (10) having a wall with an inner surface of hyperbolic and rotational-symmetrical shape, said wall converging toward the top of said vessel, a fluid inlet (101) at the top of said vessel opening directly into said fluid in which said vessel is submerged and guide vanes (12) at the bottom thereof, an unobstructed flow passage which progressively increases in cross sectional area extending from said inlet to said guide vanes, said guide vanes extending outwardly from said fluid passage to said inner surface of said hyperbolic-shaped wall and downwardly beyond said hyperbolic-shaped wall, said vanes being attached to said inner surface of said wall, a circular plate (11) positioned below said hyperbolic-shaped wall and attached to said guide vanes, a shaft (13) attached to said circular plate, and motor means attached to said shaft for rotating said shaft, said circular plate, said guide vanes and said guide vessel in unison.

2. An agitator according to claim 1, characterized in that also the outer defining surface of the vessel has a hyperbolic, rotational-symmetrical shape.

3. An agitator according to claim 1, characterized in that the guide vanes are planar.

4. An agitator according to claim 1, characterized in that the guide vanes are arcuate.

5. An agitator according to claim 2 characterized in that the guide veins are planar.

6. An agitator according to claim 2 characterized in that the guide veins are arcuate.

7. The agitator of claim 1 in which said circular plate is imperforate.

* * * * *